United States Patent [19]

Caldwell

[11] 4,105,250

[45] Aug. 8, 1978

[54] CLUSTER ASSEMBLY MEANS FOR ARTICLES OF FURNITURE AND ARTICLES INCORPORATING THE SAME

[76] Inventor: John W. Caldwell, 1829 Warwick Rd., San Marino, Calif. 91108

[21] Appl. No.: 781,850

[22] Filed: Mar. 28, 1977

[51] Int. Cl.[2] ..... A47C 1/12

[52] U.S. Cl. ..... 297/445; 108/150; 248/163; 248/188.7; 297/446; 403/388

[58] Field of Search ..... 297/440, 445, 446; 248/159, 163, 165, 188.1, 188.7; 108/150, 156, 157; 403/217, 219, 388, 397

[56] References Cited

U.S. PATENT DOCUMENTS

| | | | |
|---|---|---|---|
| 2,835,317 | 5/1958 | Valtri | 248/163 |
| 2,850,306 | 9/1958 | Gordon | 248/163 |
| 3,164,347 | 1/1965 | McMasters | 248/188.1 X |
| 3,223,368 | 12/1965 | Pollack | 248/188.7 X |
| 3,312,355 | 4/1967 | Steinmetz | 248/165 X |
| 3,312,438 | 4/1967 | Goetz et al. | 248/188.1 X |
| 3,347,509 | 10/1967 | Holz et al. | 108/150 X |
| 3,537,670 | 11/1970 | Dionne | 248/188.7 |
| 3,643,608 | 2/1972 | DeCesaris | 108/157 |
| 3,863,875 | 2/1975 | Olson | 248/163 X |
| 3,934,519 | 1/1976 | Petit | 248/165 X |

*Primary Examiner*—James C. Mitchell
*Attorney, Agent, or Firm*—Donald D. Mon

[57] ABSTRACT

Cluster assembly means for articles of furniture comprising a plurality of rigid support elements each of which has a straight slot opening from its outer wall into an inner cavity. A joinder member has an axis, an axially extending web to fit in the slot, with a pair of axially extending flanges adapted to stand one in each cavity whereby to hold the support elements together in a cluster which includes the joinder member. One or more cluster assemblies may be used to form a structural part of an article of furniture such as a chair, table or cabinet.

18 Claims, 34 Drawing Figures

CLUSTER ASSEMBLY MEANS FOR ARTICLES OF FURNITURE AND ARTICLES INCORPORATING THE SAME

This invention relates to articles of furniture and to means for assembling them.

The increasing expensiveness of assembling furniture calls for more elegant and inexpensive assembly means. It is an object of this invention to provide means for assembling together in clusters a plurality of rigid support elements whereby the furniture may expediently be assembled from relatively inexpensive components. The means of this invention is so simple that it can be assembled by the ultimate user to form an integral and reliable and rigid piece of furniture. The term "furniture" is used in its broadest meaning including such common articles as chairs, tables, cabinets, and shelving units, as examples.

A cluster assembly means according to this invention comprises a plurality of rigid support elements, each having a straight portion with a straight axis, an inner cavity, an inner wall bounding at least a part of said cavity, a slot opening onto the outer wall and into said cavity, the inner wall being adjacent to at least one edge of the slot and spaced by a reference dimension from that part of the outer wall which is adjacent to the slot. The slot has a dimension of width.

A joinder member has an axis, an axially extending web, and a pair of axially extending flanges one of which is disposed at each edge of the web and projects laterally beyond the web. The flanges have a dimension of thickness greater than the width of the slot, the web has a dimension of thickness no greater than the width of the slot, and a width not less than twice the reference dimension. With each flange disposed in a respective one of the cavities, with the respective flange bearing against the respective inner wall, the support elements are assembled in a cluster by the joinder member and held against lateral separation from one another. This cluster may be used as the sole support for a pedestal table for example, or a plurality of clusters may be used, each cluster serving as the leg of an article of furniture such as a chair or a table.

According to a preferred but optional feature of the invention, at least one of the support elements of a pair of the clusters may form a portion of the back of a chair.

According to still another preferred but optional feature of the invention, more than two of said rigid support elements may be clustered together to form a pedestal, and may be extended laterally to form feet for a base.

The above and other features of this invention will be fully understood from the following detailed description and the accompanying drawings in which:

FIG. 1 shows the presently preferred embodiment of the invention incorporated in a chair;

FIGS. 2 and 3 are cross-sections taken at lines 2—2 and 3—3 respectively in FIG. 1;

Figure 1:
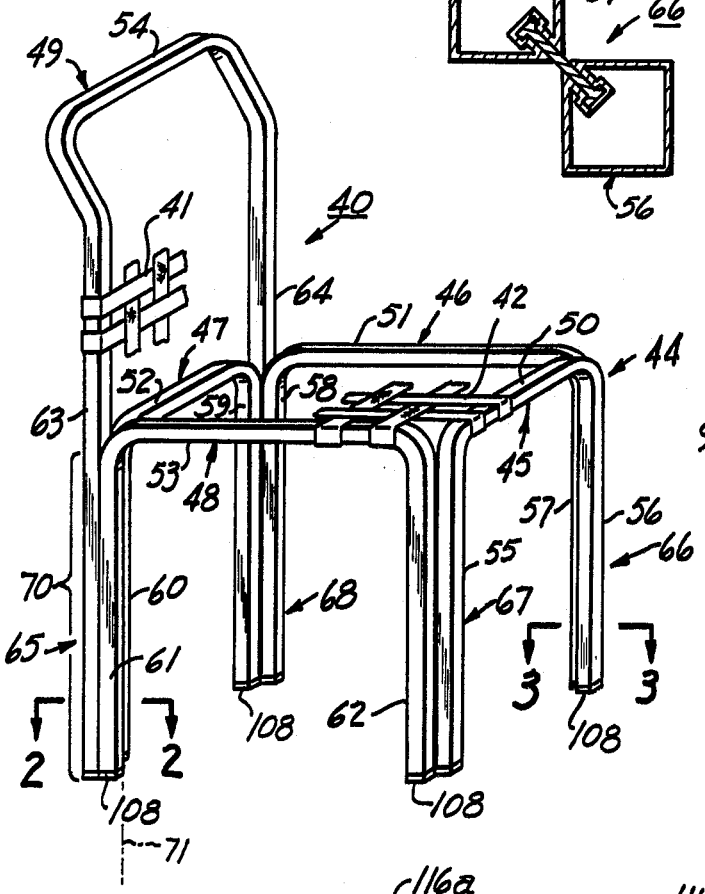

FIG. 1 shows a chair 40 having a woven webbing 41 for the back and a webbing 42 for the seat. The chair includes a frame 44 which will now be described. Frame 44 includes four U-shaped frame elements 45, 46, 47, 48 and a U-shaped back frame element 49. Cross members 50, 51, 52, 53 and 54 respectively form portions of frame elements 45, 46, 47, 48 and 49.

U-shaped frame element 45 includes a pair of rigid support elements 55, 56. U-shaped frame element 46 includes a pair of rigid support elements 57, 58. U-shaped frame element 47 includes a pair of rigid support elements 59 and 60. U-shaped frame element 48 includes a pair of rigid support elements 61 and 62. U-shaped back frame element 49 includes a pair of rigid support elements 63 and 64. Therefore each element includes a pair of rigid support elements connected by a respective cross member.

It will be seen that when assembled as shown, frame means is provided to hold the edges of the webbings so that a person can sit on the chair and lean back on it. The webbing is shown only fragmentarily. In practice it is attached to the four cross members or other rigid structure which surround it.

There are four clusters 65, 66, 67, 68. Clusters 65 and 66 will be described in detail. Cluster 67 is similar in construction to cluster 66, and cluster 68 is similar in construction to cluster 65.

With respect to cluster 65, it will be noted that the support elements 60, 61 and 63 are identical except for their total lengths. For purposes of this invention, the disclosure of support element 60 will serve as a disclosure of the remaining support elements 61 and 63 and also of elements 56 and 57 in FIG. 3. Support element 60 (see also FIG. 10) is rigid, preferably being made as a metal extrusion. Aluminum alloy is a useful metal.

Figure 10:
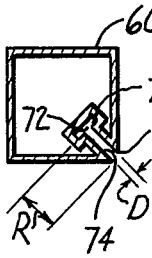
FIGS. 10–14 are cross-sections showing corner-oriented support elements.

Element 60 includes a straight portion 70 with a straight axis 71. There is an inside cavity 72 (FIG. 10) with an inner wall 73 bounding at least a part of the cavity. A slot 74 opens onto an outer wall 75 of the element. The inner wall is adjacent at least to an edge of the slot and is spaced from the outer wall adjacent to the slot by a "reference dimension" R. This feature is best shown in FIG. 10. The slot also has a dimension of width D.

A straight joinder member 80 (FIG. 9) is provided to join the elements in a cluster. It may conveniently be an extrusion formed of metal or of an organic plastic material such as polyvinyl chloride. Because the organic plastic materials can readily be colored, and in the assembled cluster a small portion of the material will usually be visible to provide a decorative touch, organic plastic material is very desirable.

Figure 9:
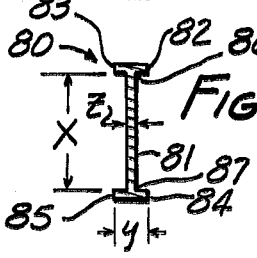

The joinder member has a straight axis parallel to axis 71 and an axially extending web 81 with a "dimension of width" X (FIG. 9).

Figure 8:
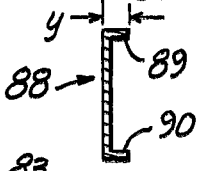

Four axially extending flanges 82, 83, 84, 85 are provided in pairs at the edges 86, 87 of the web. As can be seen from FIG. 8, only one flange need be provided at each edge but it is more reliable to provide a pair at each edge. The FIG. 8 construction comprises a joinder member 88 which includes only a pair of flanges 89 and 90, one flange at each edge.

Referring again to FIG. 9, the "dimension of thickness" Y of the flange or pair of flanges is greater than the width D of slot 74, and the dimension of thickness Z of the web is no greater than the width D of slot 74. This enables the web and the flanges to be slid into the slot, but prevents the flanges from being pulled laterally through the slot. The width X of the web is not less than twice the reference dimension in order to enable the cluster to be assembled.

Figure 4:
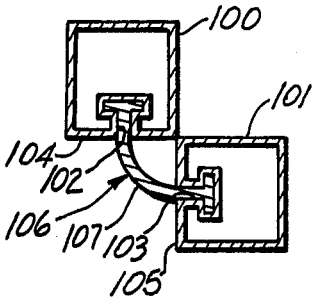
FIG. 4 is a cross-section similar to FIG. 3 showing another embodiment of the invention.

The joinder member in cluster 65 (FIG. 2) differs from that in cluster 66 by including a second web 95 with a pair of flanges 96. This additional web is integral with the central web, and extends at a right angle thereto to incorporate joinder element 63. Apart from this additional means to include a third support element, clusters 65 and 66 are identical to one another. In some embodiments of the invention, the width of the web is the total length of two parts measured from their intersection, for example of the two parts which meet at a right angle (or any other suitable angle). In FIG. 4, where the web is bent, it is the arcuate length which is measured.

Figure 3:
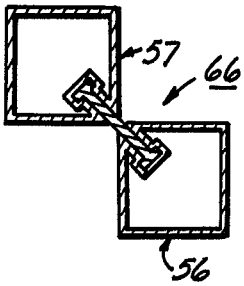
Figure 2:
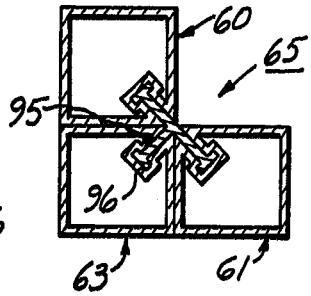

FIG. 4 shows a pair of support elements 100, 101 which are identical to one another and which differ from the support element shown in FIGS. 2 and 3 in that they are face oriented rather than edge oriented. By this is meant that in FIGS. 2 and 3 the slots open at corners while in FIG. 4 slots 102, 103 open on faces 104, 105 respectively. Apart from that the constructions are the same. However it will be noted that the joinder member 106 will be somewhat wider and will be bent when the two support elements are oriented as shown. In this case the web 107 will be bent instead of flat and will be longer than if the two faces were flush against one another or if the corners were adjacent to one another as in FIGS. 2 and 3. However the assembly technique and the rigidity of the resulting article are substantially identical.

In all of these embodiments foot members 108 will be provided at the bottom of all of the clusters. Preferably they are rigidly affixed thereto such as by screws or by a tight friction coupling so as to discourage relative sliding movement between the support elements.

Figure 5:
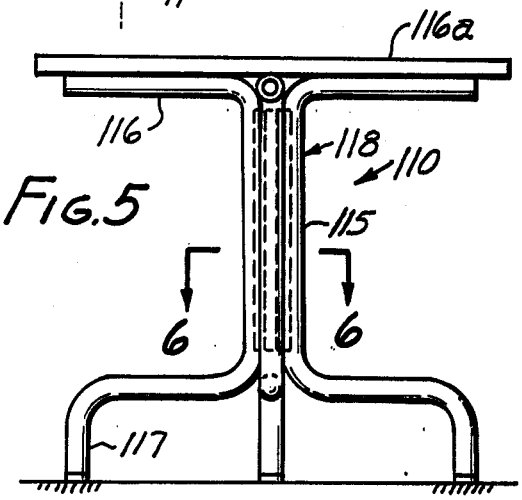
FIG. 5 is a side elevation showing another form of the invention.
Figure 6:
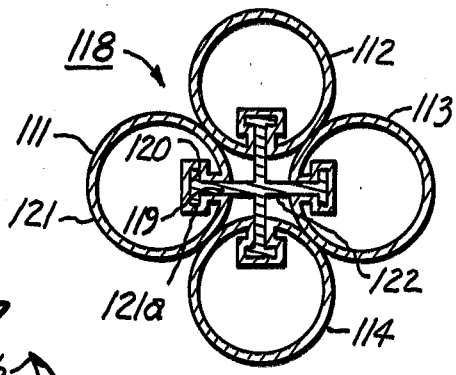
FIG. 6 is a cross-section taken at line 6—6 of FIG. 5.

In the article of furniture of FIG. 1, the article is held together by a plurality of clusters. There are types of furniture wherein one cluster will suffice for the entire assembly and such an article is shown in FIGS. 5 and 6. These show a pedestal table 110 which comprises four support elements 111, 112, 113 and 114. Each of these support elements includes a straight portion 115 with all of the features described in connection with the straight portion in FIG. 1. These support elements differ by including arms 116 at right angles to the straight portion to form a support for a table top **116*a* and laterally extending legs 117 to stand upon the ground at a lateral distance from the cluster 118**.

Figure 20:
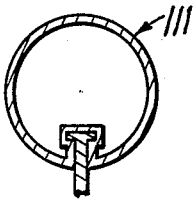
FIGS. 20–24 are cross-sections showing different cavities for support elements.
Figure 21:
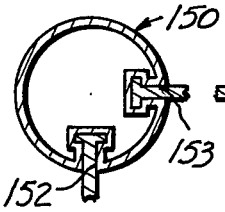
Figure 22:
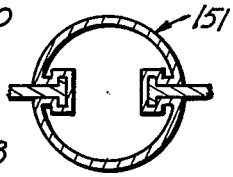
Figure 23:
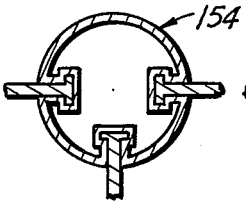
Figure 24:
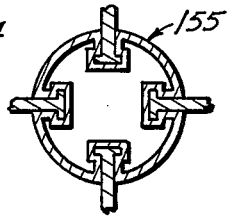

The details of cluster 118 are shown in FIG. 6, where the support elements are tubular, with other features as best shown in FIG. 20. The means for receiving and engaging with the joinder member are identical to those in FIGS. 3 and 10 to which reference should be made for full details. Suffice it to say that support element 111 (to which the others are identical) includes an axially extending slot 119 with internal cavity 120, outer wall 121, and inner wall **121*a*. The dimensions of thickness and width are the same. In cluster 118, joinder member 122 is cruciform, constituting a pair of crossed integral joinder members of the FIG. 9 type. All of the features defined in connection with FIGS. 1, 2, 3, 9 and 10** are pertinent to this device. The slots will be open either at the top or the bottom of the cluster assembly so that the joinder member can be slid into all of the slots from that end at the same time.

Figure 7:
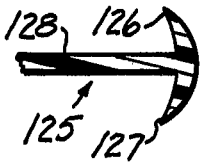
FIGS. 7, 8 and 9 are cross-sections of other forms of joinder members according to the invention.

FIG. 7 shows an edge portion of a joinder element 125 which has an umbrella-like pair of flanges 126, 127 on its end. These flanges are more readily flexible toward the web 128 than away from it. When the joinder member is made of a flexible elastomer, the cluster can be assembled by pushing the joinder member into the slot sidewise if preferred.

Figure 11:
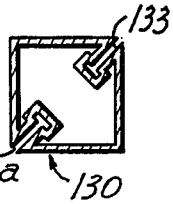
Figure 12:
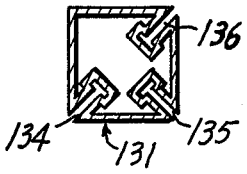
Figure 13:
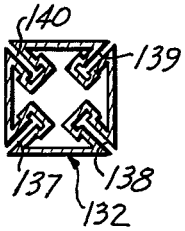
Figure 14:
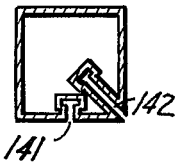

One purpose of FIGS. 10–14 is to show means by which a broad range of cluster arrangements can be made. FIG. 10 has already been disclosed and enables this support element to be a means of connection to one joinder member at its corner. FIGS. 11, 12 and 13 show support elements 130, 131, 132 which have respective pluralities of slots **132*a*, 133; 134, 135, 136; and 137, 138, 139 and 140 to accomodate two, three or four joinder members at corners thereof. FIG. 14 shows that a joinder member can have slots 141, 142**, one of which can be face oriented, and the other edge oriented. In other words, all slots of a given support element need not be edge oriented or face oriented, but they may be mixed.

Figure 15:
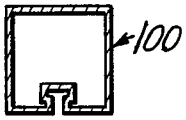
FIGS. 15–19 are cross-sections showing face-oriented support elements.

FIG. 15 has already been discussed. The purpose of FIGS. 16–19 is to show other support elements 145, 146, 147, 148 which are also adaptable to connection to more than one joinder member and in various combinations wherein the slots are face oriented.

Figure 16:
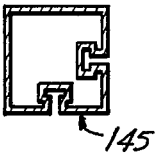
Figure 17:
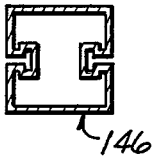
Figure 18:
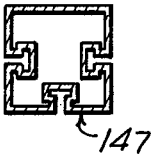
Figure 19:
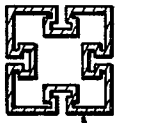

FIGS. 16 and 17 show that a pair of face oriented elements may be placed in either adjacent faces or opposite faces. FIGS. 18 and 19 show that three or four joinder elements may be accommodated in a face-oriented arrangement.

FIG. 20 has already been described. One purpose of FIGS. 21, 22, 23 and 24 is to show different angular orientations in circular support members. For example in FIGS. 21 and 22 support elements 150, 151 have slots 152, 153 at different angular orientations from one another, while in FIGS. 23 and 24 support elements 154, 155 have three and four slots respectively.

Figure 25:
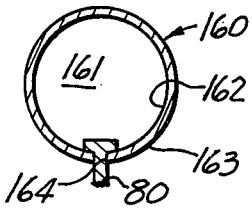
FIGS. 25, 26 and 27 are lateral cross-section views of still other types of support elements.
Figure 26:
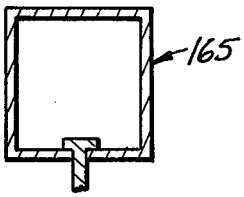
Figure 27:
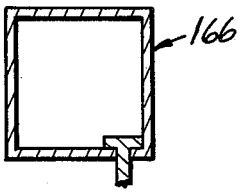

One purpose of FIGS. 25–27 is to show that it is not necessary to form an extruded slot and cavity in the support member. Instead it is possible simply to slit the wall of the support member and use the inside wall of the tubular support member for engagement by the flange. For example in FIG. 25 there is shown a circular support member 160 which has an internal cavity 161, an inner wall 162 defining the cavity, and an outer wall 163 defining the outside of the member. A slot 164 is cut in the wall. A joinder member such as joinder member 80 (FIG. 9) is placed therein, just as is done in the other embodiments of the invention. The width of the slot, the reference dimension, and all other features of the support member are as described in connection with the other embodiments of the invention, with the exception that the cavity is larger, and is not bounded on its backside as it is in the other extruded portions. These constructions as a practical matter will not accommodate more than one slot.

FIGS. 26 and 27 show joinder members 165, 166 which have square instead of circular sections, and differ from one another in that the slot in FIG. 27 is located closer to the corner than to the center of a face as in FIG. 26.

Figure 28:
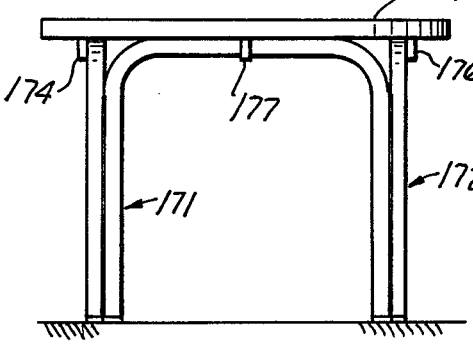
FIG. 28 shows another table construction according to the invention.
Figure 29:
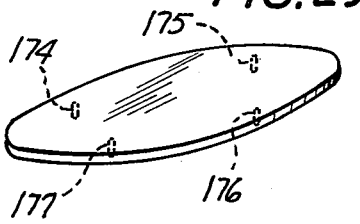
FIG. 29 shows a top for the table of FIG. 28.

FIG. 28 shows a table 170 which is formed with four legs, only two of which are shown. The legs are formed by clusters 171, 172. Two other clusters are hidden behind clusters 171 and 172 in FIG. 28. These clusters may conveniently be the same type shown in FIG. 3, but may instead be of any other two member combinations. The table assembly is completed by a rigid top 173 which rests on the cross members of the support elements comprising the clusters and four flange members 174, 175, 176, 177 which fit down over and against respective cross members so as to hold the assembly in its square position. These depending flanges hold the table in its square array. Of course, furniture of more or fewer sides than four can be made with this invention.

Figure 30:
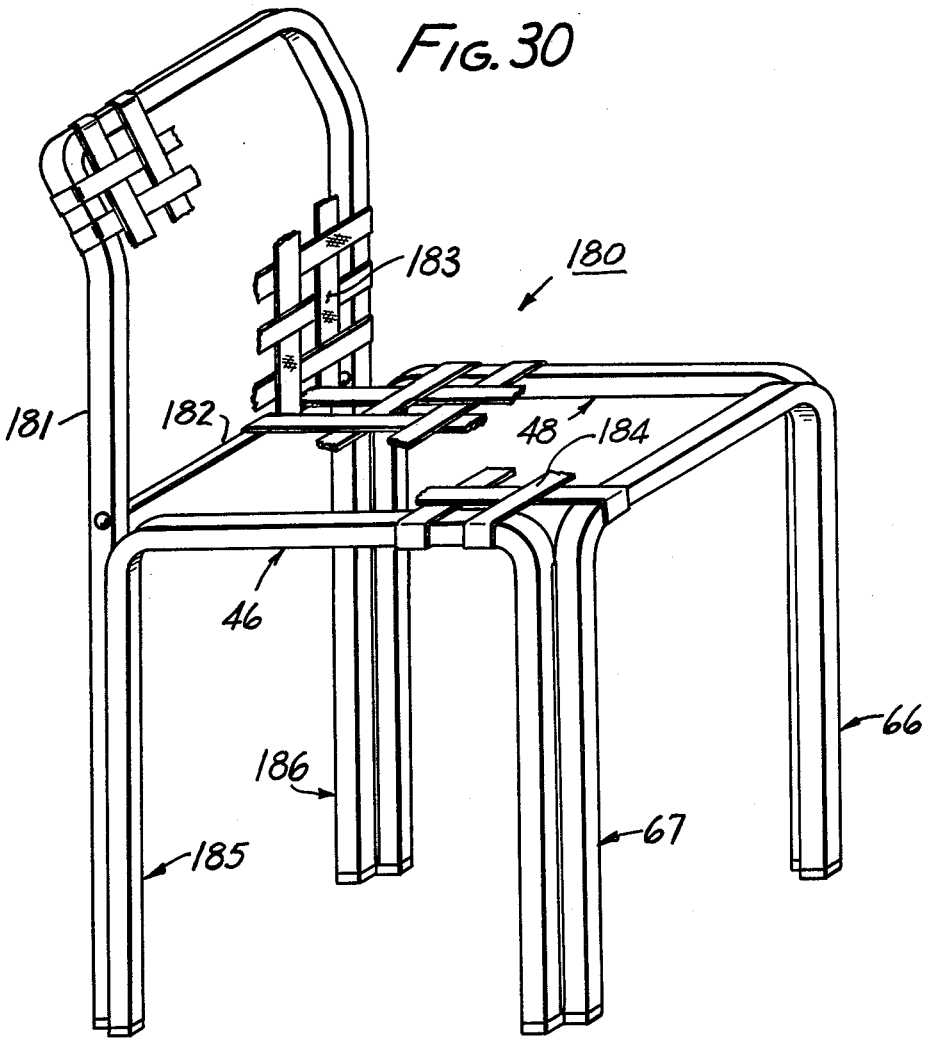
FIG. 30 shows another embodiment of chair according to the invention.

FIG. 30 shows a chair 180 similar to the chair of FIG. 1 with the exception that the back member forms part of a two member cluster, instead of part of a three member cluster. This chair 180 includes clusters 66 and 67 just as in the chair of FIG. 1. However the rear U-shaped frame element 181 joins with frame elements 46 and 48 in an assembly of the type of FIG. 3. To add rigidity and a means to hold an edge of the webbing or other seat material, a cross tie 182 is provided between the two legs of element 181. Cross tie 182 may conveniently form a location for anchoring one edge of the woven webbing 183. A seat webbing 184 is provided as in the embodiment of FIG. 1. With the exception of the shape of clusters 185 and 186 the construction of the chair of FIG. 30 is the same as that of FIG. 1.

Figure 31:
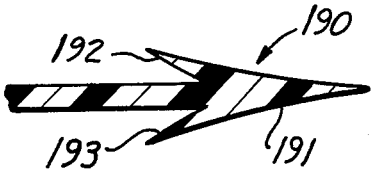
FIGS. 31 and 32 show other embodiments of joinder members.
Figure 32:
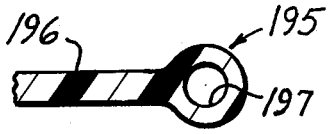

FIGS. 31 and 32 show other embodiments of joinder members, which can be pressed sidewise into the slot as alluded to in connection with the device shown in FIG. 7. An edge portion of a joinder member 190 is shown with an arrowhead type flange 191 whose two protrusions 192, 193 can be compressed toward one another to enable the joinder member to be thrust through the slot. These spread to resist removal.

Figure 33:
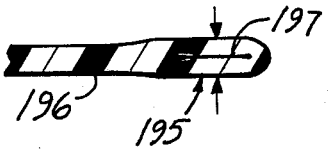
FIG. 33 shows the joinder member of FIG. 32 compressed.

In FIG. 32 flange 195 on an edge portion of a joinder member 196 is a bulb with an internal axially extending open passage 197 therein. As shown in FIG. 33 this bulb can be compressed to pass the flange through the slot. It will expand when it is on the backside of the inner wall. In both the embodiments of FIGS. 31 and 32 the material is flexible and preferably elastomeric.

Figure 34:
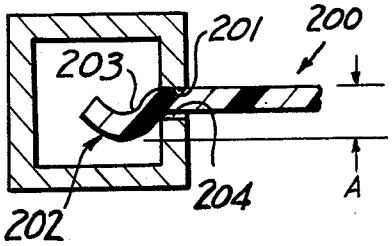
FIG. 34 shows still another embodiment of joinder member according to the invention.

In FIG. 34 there is shown a joinder member 200 with a slot 201 as in the other embodiments. An edge portion of a joinder member 202 passes through the slot. The flange, instead of being an abrupt hook-like or bar-like member, instead is a curved member 203. The joinder member may either be elastomeric or might even be somewhat more rigid but the distance A by which it projects sidewardly from its wall 204 constitutes a flange type overhang which functions in precisely the same manner as the flanges in the other embodiments. This assembly can readily be made either from the side or from the top of the slot and the thickness of the joinder member throughout will be somewhat less than the width of the slot. The bend acts as a flange.

In addition to the reception of the joinder members, the slots can be used to retain the edge of webbing or sheets of material to form a seat or back. Alternatively, the webbing or sheet can be adhesively attached to, wrapped around, or bent around some portion of the frame member.

The term "transverse means" is sometimes used herein to denote structure which enables the framework provided by a cluster or clusters to be used as an article of furniture. In FIGS. 1 and 30, this means is a webbing. Of course flexible material such as canvas could be used, or a rigid plastic wood or metal seat. In FIGS. 5 and 25 the transverse means is a table top.

The necessary strength and rigidity of the joinder means is related to its usage. When the flange is totally trapped as in FIG. 3, more flexibility, and a greater spacing apart of the support members is possible than when the flange is loose in the cavity as in FIGS. 25–27. Primarily the joinder means is intended to prevent the support means from spreading apart or twisting excessively. Support against relative shear movement of the support members can be provided by a strong web gripped tightly by the support member. However, this makes assembly more difficult, and it is better practice to restrain shear movement by foot members 108 or otherwise.

The spacing between adjacent support members is preferably kept as small as practicable.

The foregoing constructions illustrate cluster assemblies suitable for articles of furniture, and also illustrate a few exemplary articles of furniture assembled therefrom. The slots will be open at one end when cluster assembly is to be made from an end. In some embodiments the flanges may be thrust through the slot itself. By whatever means, there is provided cluster assemblies for furniture which can readily be assembled by the user or by factory labor quickly and expeditiously. The frame members may be simple extrusions or slit tubings of desired cross-section whether square, round or otherwise and the joinder members may be rolled or extruded shapes as preferred. The support elements will usually be made of rigid material. The joinder members may be made of rigid or flexible material such as metal or elastomers as appropriate to the installation.

This invention is not to be limited by the embodiments shown in the drawings and described in the description which are given by way of example and not of limitation, but only in accordance with the scope of the appended claims.

I claim:

1. Cluster assembly means for an article of furniture comprising: a plurality of rigid support elements, each having a straight portion with an axis, an inside cavity, an inner wall bounding at least part of said cavity, a slot opening onto said outer wall and into said cavity, said inner wall being adjacent to at least one edge of the slot and spaced from that part of the outer wall adjacent to the slot by a reference dimension, said slot having a dimension of width; and a straight joinder member having an axis, an axially extending web, and an axially extending flange, one at each edge of the web and projecting laterally beyond said web, the flanges having a dimension of thickness greater than the width of the slot, the web having a dimension of thickness no greater than the width of the slot and a width not less than twice the reference dimension, each flange being disposed in a respective one of said cavities with its respective flange bearing against the respective inner wall and with its web passing through the respective slot, whereby the support elements are held in a cluster with the joinder member holding them against lateral separation from one another.

2. Cluster assembly means according to claim 1 in which the web is flexible.

3. Cluster assembly means according to claim 1 in which the web is rigid.

4. Cluster assembly means according to claim 1 in which the flanges are relatively stiff and resist bending relative to the web.

5. Cluster assembly means according to claim 1 in which the flanges are flexible and yield to enable them to be pressed through the slot.

6. Cluster assembly means according to claim 1 in which the slot is open at one end to enable the joinder member to be slid into the slot from said end.

7. Cluster assembly means according to claim 6 in which the web is rigid.

8. Cluster assembly means according to claim 7 in which the flanges are relatively stiff and resist bending relative to the web.

9. Cluster assembly means according to claim 1 in which the flanges are bar-like.

10. Cluster assembly means according to claim 1 in which the flanges include flexible means to flex and permit insertion into the slot, and which spring back to hold the joinder member to the support element.

11. An article of furniture comprising: a plurality of rigid support elements, each said upright means comprising: a plurality of rigid support elements, each having a straight portion with an axis, an inside cavity, and inner wall bounding at least part of said cavity, a slot opening onto said outer wall and into said cavity, said inner wall being adjacent to at least one edge of the slot and spaced from that part of the outer wall adjacent to the slot by a reference dimension, said slot having a dimension of width; and a plurality of straight joinder members each having a straight axis, an axially extending web, and an axially extending flange, one at each edge of the web and projecting laterally beyond said web, the flanges having a dimension of thickness greater than the width of the slot, the web having a dimension of thickness no greater than the width of the slot and a width not less than twice the reference dimension, each flange being disposed in a respective one of said cavities with its respective flange bearing against the respective inner wall and with its web passing through the respective slot, whereby a plurality of support elements are held in a cluster and prevented from lateral separation from one another by their respective joinder memebers, there being a plurality of said clusters; and a plurality of cross members, each cross member connecting a support element of one cluster to a support element of another cluster, whereby to form an array of substantially parallel clusters spaced from one another to form a base.

12. An article of furniture according to claim 11 in which transverse means overlays the base and is supported thereby.

13. An article of furniture according to claim 12 in which said transverse means comprises a seat.

14. An article of furniture according to claim 12 in which said transverse means comprises a table top.

15. An article of furniture according to claim 13 in which the transverse means includes a seat back.

16. An article of furniture according to claim 10 in which the transverse means is a web.

17. An article of furniture comprising a plurality of rigid support elements, each said upright support means comprising: a plurality of rigid support elements, each having a straight portion with an axis, an inside cavity, an inner wall bounding at least part of said cavity, a slot opening onto said outer wall and into said cavity, said inner wall being adjacent to at least one edge of the slot and spaced from that part of the outer wall adjacent to the slot by a reference dimension, said slot having a dimension of width; and a straight joinder member having a straight axis; an axially extending web, and an axially extending flange, one at each edge of the web, and projecting laterally beyond said web, the flanges having a dimension of thickness greater than the width of the slot, the web having a dimension of thickness no greater than the width of the slot and a width not less than twice the reference dimension, each flange being disposed in a respective one of said cavities with its respective flange bearing against the respective inner wall and with its web passing through the respective slot, whereby a plurality of support elements are held in a cluster and prevented from lateral separation from one another by the joinder member; means to support the cluster as a pedestal; and transverse means atop the pedestal.

18. An article of furniture according to claim 17 in which the means to support the cluster comprises portions of the support means bent to form legs.

* * * * *